US006537020B2

(12) United States Patent
Humhauser

(10) Patent No.: US 6,537,020 B2
(45) Date of Patent: Mar. 25, 2003

(54) CASING STRUCTURE OF METAL CONSTRUCTION

(75) Inventor: Werner Humhauser, Moosburg (DE)

(73) Assignee: MTU Aero Engines GmbH, Munich (DE)

( * ) Notice: Subject to any disclaimer, the term of this patent is extended or adjusted under 35 U.S.C. 154(b) by 0 days.

(21) Appl. No.: 09/844,012

(22) Filed: Apr. 27, 2001

(65) Prior Publication Data

US 2001/0048876 A1 Dec. 6, 2001

(30) Foreign Application Priority Data

Apr. 27, 2000 (DE) ..... 100 20 673

(51) Int. Cl.[7] ..... F03B 11/00
(52) U.S. Cl. ..... 415/173.1; 415/200
(58) Field of Search ..... 415/173.1, 173.4, 415/9, 200, 174.4, 173.5

(56) References Cited

U.S. PATENT DOCUMENTS 3,126,149 A 3/1964 Bowers, Jr. et al. ..... 415/173.4
3,425,665 A * 2/1969 Lingwood ..... 415/134
4,666,371 A * 5/1987 Alderson ..... 415/197
4,867,639 A * 9/1989 Strangman ..... 415/173.4
5,228,195 A * 7/1993 Brown et al. ..... 29/888.3

FOREIGN PATENT DOCUMENTS

| | | |
|---|---|---|
| DE | 1 551 183 | 4/1970 |
| EP | 0 728 258 | 6/1998 |
| EP | 0 616 113 | 7/1998 |
| EP | 0 781 371 | 12/1998 |
| WO | 98/26158 | 6/1998 |

* cited by examiner

*Primary Examiner*—Edward K. Look
*Assistant Examiner*—Dwayne J. White
(74) *Attorney, Agent, or Firm*—Kenyon & Kenyon

(57) ABSTRACT

A casing structure of metal construction for the rotor blade area of axial flow compressor and turbine stages includes a closed, stable outside wall, a segmented inside wall that is interrupted by multiple expansion joints, and a load-transmitting connecting structure between inside and outside wall. A multiple sub-divided hollow chamber structure with a plurality of thin wall elements standing upright on the inside wall and outside wall, at least the majority of which are directly connected together, is arranged as connecting structure. The hollow chamber structure is connected to the inside wall and/or the outside wall by brazing.

13 Claims, 2 Drawing Sheets

CASING STRUCTURE OF METAL CONSTRUCTION

FIELD OF THE INVENTION

The present invention relates to a casing structure of metal construction for the rotor blade area of axial flow compressor and turbine stages.

BACKGROUND INFORMATION

It is very important for the technical flow characteristics of compressor and turbine stages that the radial gap between the rotor blade tips and the casing be kept as small and as constant as possible. For this purpose, the casing structure should first be sufficiently stable in its dimensions and geometrically accurate. Thermal and mechanical influences should alter the geometry as little as possible. The mostly hot working gas should essentially act only on the inside wall of the structure, in order to minimize leakage losses through the structure. In variable operation, it is advantageous if the timing and magnitude of the changes, particularly thermally induced dimensional changes, of the casing structure are matched to those of the bladed rotor. Since mechanical contacts between the blade tips and the casing can rarely be avoided under certain loads, the inside wall of the casing structure should be deformable/flexible or abradable, at least on the blade tip side.

European Published Patent Application No. 0 728 258 relates to a shroud segment of a turbine, which together with segments of the same type forms the inside wall and a part of the connecting structure to the outside wall of a wall structure. Due to temperature differences between the inside and the cooled outside of the segments in operation, and to differences in the material properties of the base material and a coating generally applied, the segments have a tendency to alter their curvature. In order to prevent the segments locally shifting into the orbit of the blade tips, they are in places connected to the outer area of the casing structure by a special, hook-shaped geometry on leading and trailing edges, which in places permits a radial movement outwardly. Since the internal contour therefore often deviates from the circular with a tendency to form a polygon, it is difficult to maintain a defined gap. The sealing of the segments subject to a variable gap and play also makes for an expensive design.

European Published Patent Application No. 0 781 371 describes an arrangement for the dynamic control of blade tip play in gas turbines. The inside wall of the casing structure includes curved, circular arc-shaped segments, capable of moving radially outwardly and overlapping in a circumferential direction, the inward radial movement of which is limited by a peripheral casing structure, unilaterally retaining their leading and trailing edges in the manner of a hook. The segments are preloaded radially inwardly against a stop by mechanical spring elements or by gas pressure. The rotor blades include wedge faces at the tip, which, under high-speed rotation, generate a dynamic gas cushion, the pressure of which is intended to hold the wall segments at a small, defined distance from the blade tips. In so doing, an equilibrium must be established between internal gas pressure and external spring force, which keeps the segments in balance. Such a system appears very prone to malfunction, difficult to calculate and susceptible to oscillation. The retaining structure for the segments is exposed to the working gas and hence to potentially high thermal loads and also conducts a considerable amount of heat to the outside wall of the structure.

European Published Patent Application No. 0 616 113 relates to a gas turbine and a method for the fitting of a seal in the said gas turbine and describes the use of metal honeycombs as running-in surfaces for labyrinth seals. The honeycombs are brazed on one side to a sheet metal carrier, generally of closed annular geometry, its openings facing annular, bezel-like sealing tips. The deformation behavior of the thin, ductile, upright honeycomb walls speeds up any running-in process that may be necessary and protects the sealing tips. The open structure with a plurality of chambers increases the sealing effect by diverting and swirling the flow. In aircraft and boat construction, sandwich-type lightweight structures are used, in which a relatively thick, light core with a high proportion of void space, for example, a honeycomb, is covered with and connected to thin, high-strength closed walls. When such a structure flexes, the walls are primarily subjected to tensile or compressive loading in their plane, while the core transmits the forces, e.g., shear forces, from wall to wall. The walls may be of fiber-reinforced construction, bonded to the core and at least comparable in their thickness and mechanical characteristics.

It is an object of the present invention to provide a casing structure of metal construction for the rotor blade area of axial flow compressor and turbine stages, which provides a high dimensional and geometrical accuracy under changing operating conditions and temperatures, a high mechanical load-bearing capacity, good thermal insulation effect and a minimal operating fluid leakage through the structure, and which by particularly small, substantially non-varying gaps with the rotor blade tips permits a high stage efficiency and a high stage load.

SUMMARY

The above and other beneficial objects of the present invention are achieved by providing a casing structure as described herein. The present invention therefore relates to the connecting structure arranged between the segmented inside wall and the closed, load-bearing outside wall, and in the fused integration of their materials. The connecting structure is designed as a light, filigree hollow-chamber structure, for example, as a honeycomb structure, occupying substantially all of the hollow space between the inside and outside wall and is connected to one or both walls by brazing. Due to the "quasi sheet-like" connection of the walls, it is possible to impress the geometrical accuracy of the load-bearing outside wall on the segmented inside wall in all operating conditions. Any warping or "polygonization" of the internal contour may consequently be prevented. Its "sheet-like character" makes the brazed connection ideal in terms of mechanical strength and durability and does not have any negative effect on the structure of the material. On the other hand, the filigree connecting structure is sufficiently elastic to permit thermal expansion/contraction of the inside wall segments in a circumferential direction without critical constraining forces. The connecting structure has a thermally insulating effect, which is due to its high proportion of void space and may also be influenced by the choice of material. The inside wall therefore absorbs the generally high temperature of the working gas, and the outside wall may be kept distinctly cooler, which is beneficial to its mechanical characteristics. The insulating effect may also improve the thermodynamic efficiency of the engine. The filigree connecting structure is substantially impermeable to gas in a circumferential and axial direction, so that additional sealing measures may be eliminated. The leakage through the few, small expansion joints of the inside wall is of no significance.

DETAILED DESCRIPTION

Figure 1:
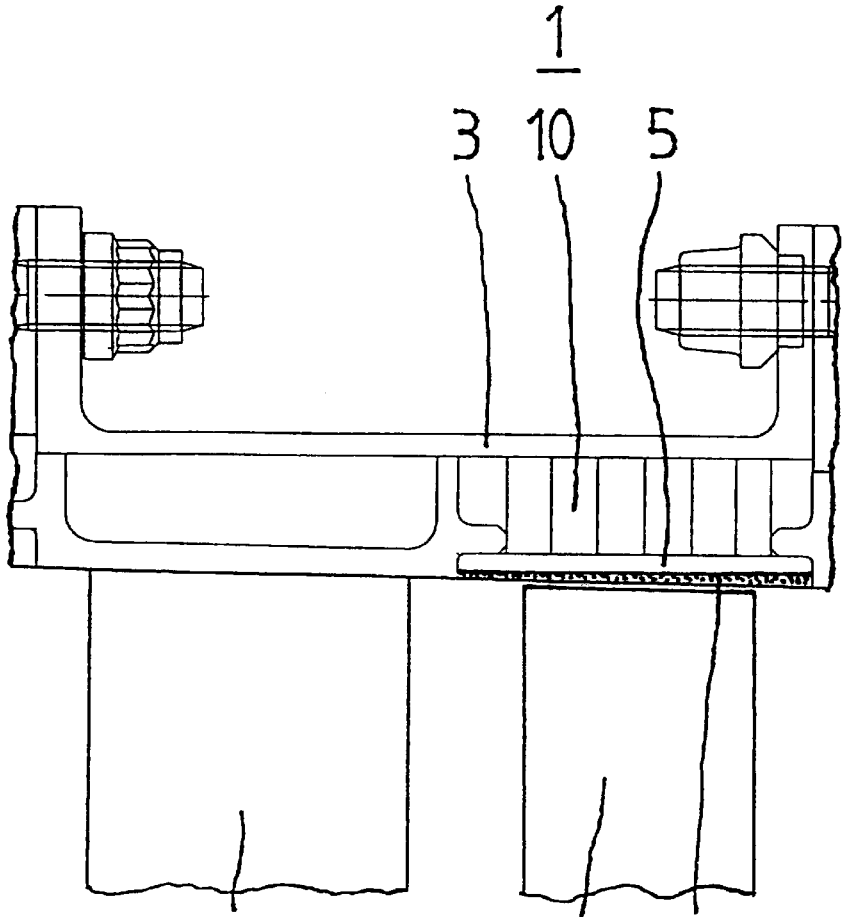
FIG. 1 is a partial longitudinal cross-sectional view through a compressor in the area of a guide vane and rotor blade rim.

The casing structure illustrated in FIG. 1 is part of an axial-flow compressor, through which the flow is designed to pass from left to right. The radially outer part of a guide vane 21 and a shroudless rotor blade 20 can be seen. The outside wall 3 of the casing structure extends over both blade areas, the suspension of the guide vane 21 being of positively interlocking, i.e., conventional, type. The casing structure 1 according to the present invention is situated on the right of FIG. 1, i.e., in the area of the rotor blade 20, and includes an inside wall 5, a hollow chamber structure 10 and the part of the outside wall 3 lying opposite the inside wall 5, i.e., the right-hand part up to the flange. The inside wall 5 is provided with a running-in surface to protect the rotor blade tips as they skim over. The inside wall 5 including the running-in surface 9 is segmented, i.e., it has a number of expansion joints 7, extending primarily in an axial direction and distributed over the circumference (see FIG. 2). The casing structure 1 constitutes an integral formation with fused material connection of its elements 3, 5 and 10. The hollow chamber structure 10 is soldered to the outside wall 3 and the inside wall 5. It is also possible to manufacture the hollow chamber structure integrally with one of the two walls and then solder it to the other wall.

Figure 2:
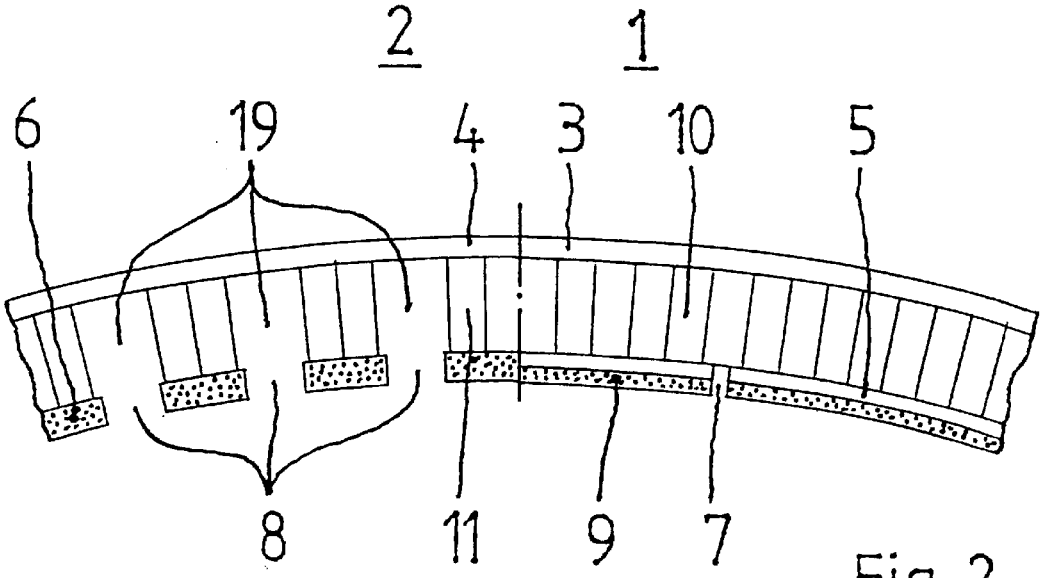
FIG. 2 is a partial cross-sectional view through two different casing structures.

FIG. 2 is a partial cross-sectional view through two different casing structures 1, 2 according to the present invention, on the right-hand side and left-hand side respectively of a vertical dot-and-dash line in the center of the drawing. The right-hand casing structure 1 corresponds to that illustrated in FIG. 1, an expansion joint 7 extending through the inside wall 5 and the running-in surface 9 being illustrated.

The left-hand casing structure 2 differs from the right-hand firstly in that its inside wall 6 is composed over the entire thickness of a material that may readily be deformed or abraded by the blade tips. The material may be a porous metal with or without embedded plastic, graphite or other substances, for example, in the form of a sintered structure. The outside wall 4 and the hollow chamber structure 11 have no distinguishing characteristics compared to the corresponding items 3 and 10. However, a special design measure in the form of a so-called "casing treatment" is illustrated, which may improve the aerodynamics in compressors by increasing the efficiency or the pumping limit. For this purpose, the inside wall 6 is provided with geometrically defined openings 8 uniformly distributed over the circumference. In the hollow chamber structure 11, recesses 19 interact with the openings 8 and form recirculation chambers for a part of the compressor flow in the blade tip area. In an axial direction, the openings 8 and recesses 19 extend upstream to a location in front of the blade inlet edges, downstream they end behind the axial blade center and in front of the blade outlet edges. This arrangement is conventional and is therefore not shown separately. The recesses in the hollow chamber structure need not necessarily extend radially as far as the outside wall. It is possible to level out the partially recessed hollow chamber structure with a filler material, i.e., to smooth the flow. It may also be beneficial to orient the longitudinal center planes of the openings and recesses inclined in a circumferential direction rather than radially. These alternative arrangements should be readily understood to a person skilled in the art without further explanation.

Figure 3:
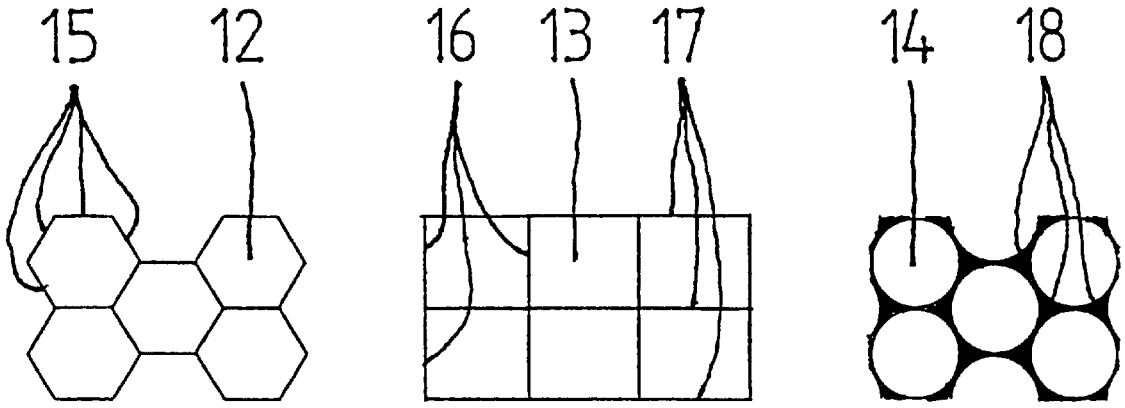
FIG. 3 is a partial cross-sectional view through three different hollow chamber structures.

FIG. 3 illustrates, by way of example, three different hollow chamber structures 12, 13 and 14 in sections parallel to the inside and outside wall of the casing structure. A honeycomb structure with equilateral, hexagonal honeycombs is illustrated on the left, the connected wall elements 15 of which are therefore geometrically identical in size and are arranged at 120° to one another.

The middle structure 13 includes rectangular chambers, which are bounded by smaller wall elements 16 and larger wall elements 17 arranged at right angles.

The right-hand structure 14 is similar to the left-hand structure 12, but in the structure 14 the hollow chambers have a circular, instead of a hexagonal, shape. This arrangement results in wall elements 18 with a locally varying thickness. The hollow chamber structure 14 may be produced, for example, by mechanical or electrochemical boring in an initially thick-walled solid material. With reference to the casing structure according to the present invention, the inside or outside wall may in this way be produced integrally with the hollow chamber structure, the other wall in each case being integrated by brazing. The filigree structures 12 and 13 are more easily manufactured separately from sheet metal strips, expanded metal, etc.

What is claimed is:

1. A casing structure of metal construction for a rotor blade area of an axial flow compressor and turbine stages, comprising:

a closed, circular, mechanically stable outside wall;

an inside wall having a circumference interrupted by a plurality of non-overlapping expansion openings, the inside wall being disposed at a slight radial distance from a rotor blade tip; and a connecting structure disposed between the inside wall and the outside wall, the connecting structure being configured to transmit a load in at least a radial direction, the connecting structure including:

a multiple subdivided hollow chamber structure, the chamber structure extending at least over a portion of opposing surface areas of the inside wall and the outside wall, the chamber structure including a plurality of thin wall elements arranged upright on the inside wall and the outside wall and arranged at an angle to each other, at least a majority of the thin wall elements being directly connected together, the hollow chamber structure being connected to at least one of the inside wall and the outside wall by brazing.

2. The casing structure according to claim 1, wherein the axial flow compressor and turbine stages are disposed in a gas turbine engine.

3. The casing structure according to claim 1, wherein the hollow chamber structure includes a honeycomb structure.

4. The casing structure according to claim 1, wherein the hollow chamber structure is produced integrally with one of the inside wall and the outside wall by abrasive machining.

5. The casing structure according to claim 4, wherein the abrasive machining includes at least one of milling, boring and electrochemical erosion.

6. The casing structure according to claim 1, wherein the inside wall is segmented.

7. A casing structure of metal construction for a rotor blade area of an axial flow compressor and turbine stages, comprising:

a closed, circular, mechanically stable outside wall;

a segmented inside wall having a circumference interrupted by a plurality of expansion openings, the inside wall being disposed at a slight radial distance from a rotor blade tip, wherein the segmented inside wall is configured as a running-in surface; and a connecting structure disposed between the inside wall and the outside wall, the connecting structure being configured to transmit a load in at least a radial direction, the connecting structure including:

a multiple subdivided hollow chamber structure, the chamber structure extending at least over a portion of opposing surface areas of the inside wall and the outside wall, the chamber structure including a plurality of thin wall elements arranged upright on the inside wall and the outside wall and arranged at an angle to each other, at least a majority of the thin wall elements being directly connected together, the hollow chamber structure being connected to at least one of the inside wall and the outside wall by brazing.

8. The casing structure according to claims 7, wherein an entire material cross-section of the segmented inside wall is configured as the running-in surface.

9. The casing structure according to claim 7, wherein the running-in surface includes a porous metal body.

10. The casing structure according to claim 9, wherein the porous metal body includes an embedded material.

11. A casing structure of metal construction for a rotor blade area of an axial flow compressor and turbine stages, comprising:

a closed, circular, mechanically stable outside wall;

a segmented inside wall having a circumference interrupted by a plurality of expansion openings, the inside wall being disposed at a slight radial distance from a rotor blade tip, wherein a blade side of the segmented inside wall includes a coating in the form of a running-in surface, the coating being one of mechanically deformable and abradable by contact with the rotor blade tips; and a connecting structure disposed between the inside wall and the outside wall, the connecting structure being configured to transmit a load in at least a radial direction, the connecting structure including:

a multiple subdivided hollow chamber structure, the chamber structure extending at least over a portion of opposing surface areas of the inside wall and the outside wall, the chamber structure including a plurality of thin wall elements arranged upright on the inside wall and the outside wall and arranged at an angle to each other, at least a majority of the thin wall elements being directly connected together, the hollow chamber structure being connected to at least one of the inside wall and the outside wall by brazing.

12. A casing structure of metal construction for a rotor blade area of an axial flow compressor and turbine stages, comprising:

a closed, circular, mechanically stable outside wall;

an inside wall having a circumference interrupted by a plurality of expansion joints, the inside wall being disposed at a slight radial distance from a rotor blade tip; and a connecting structure disposed between the inside wall and the outside wall, the connecting structure being configured to transmit a load in at least a radial direction, the connecting structure including:

a multiple subdivided hollow chamber structure, the chamber structure extending at least over a portion of opposing surface areas of the inside wall and the outside wall, the chamber structure including a plurality of thin wall elements arranged upright on the inside wall and the outside wall and arranged at an angle to each other, at least a majority of the thin wall elements being directly connected together, the hollow chamber structure being connected to at least one of the inside wall and the outside wall by brazing;

wherein the inside wall is segmented, the segmented inside wall is configured as a running-in surface, the running-in surface includes a porous metal body, the porous metal body includes an embedded material; and wherein the embedded material includes at least one of plastic and carbon.

13. A casing structure of metal construction for a rotor blade area of an axial flow compressor and turbine stages, comprising:

a closed, circular, mechanically stable outs de wall;

an inside wall having a circumference interrupted by a plurality of expansion joints, the inside wall being disposed at a slight radial distance from a rotor blade tip; and a connecting structure disposed between the inside wall and the outside wall, the connecting structure being configured to transmit a load in at least a radial direction, the connecting structure including:

a multiple subdivided hollow chamber structure, the chamber structure extending at least over a portion of opposing surface areas of the inside wall and the outside wall, the chamber structure including a plurality of thin wall elements arranged upright on the inside wall and the outside wall and arranged at an angle to each other, at least a majority of the thin wall elements being directly connected together, the hollow chamber structure being connected to at least one of the inside wall and the outside wall by brazing;

wherein the inside wall is segmented; and wherein the segmented inside wall includes a plurality of distributed geometrically defined openings, the hollow chamber structure being one of set back and recessed in an area of the openings.

* * * * *